US009512703B2

(12) United States Patent
Gano et al.

(10) Patent No.: US 9,512,703 B2
(45) Date of Patent: Dec. 6, 2016

(54) DOWNHOLE FLUID FLOW CONTROL SYSTEM AND METHOD HAVING DYNAMIC RESPONSE TO LOCAL WELL CONDITIONS

(71) Applicant: Halliburton Energy Services, Inc., Houston, TX (US)

(72) Inventors: John Charles Gano, Carrollton, TX (US); Luke William Holderman, Plano, TX (US); Michael Linley Fripp, Carrollton, TX (US); Jason D. Dykstra, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 288 days.

(21) Appl. No.: 14/201,825

(22) Filed: Mar. 8, 2014

(65) Prior Publication Data

US 2014/0182856 A1 Jul. 3, 2014

Related U.S. Application Data

(63) Continuation of application No. 13/459,654, filed on Apr. 30, 2012, now Pat. No. 8,701,777.

(30) Foreign Application Priority Data

Aug. 29, 2011 (WO) ..... PCT/US2011/049527

(51) Int. Cl.
*E21B 43/14* (2006.01)
*E21B 34/06* (2006.01)
*E21B 34/08* (2006.01)

(52) U.S. Cl.
CPC ..... *E21B 43/14* (2013.01); *E21B 34/06* (2013.01); *E21B 34/08* (2013.01)

(58) Field of Classification Search
CPC ..... E21B 43/14; E21B 34/08; E21B 34/06
See application file for complete search history.

(56) References Cited

U.S. PATENT DOCUMENTS 8,701,777 B2 * 4/2014 Gano ..... E21B 34/06 166/306
2006/0021757 A1 * 2/2006 Patel ..... E21B 43/14 166/386

(Continued)

FOREIGN PATENT DOCUMENTS

WO 2009149031 12/2009

OTHER PUBLICATIONS

ISRWO; PCT/US2011/049527; KIPO; Apr. 19, 2012.

*Primary Examiner* — Brad Harcourt
(74) *Attorney, Agent, or Firm* — Haynes and Boone, LLP

(57) ABSTRACT

A downhole fluid flow control system having dynamic response to local well conditions. The system includes a tubing string operably positionable in a wellbore. Annular barriers are positioned between the tubing string and the wellbore to isolate first and second zones. A fluid flow control device is positioned within each zone. A flow tube that is operably associated with the fluid flow control device of the first zone is operable to establish communication between the second zone and the fluid flow control device in the first zone such that a differential pressure between the first zone and the second zone is operable to actuate the fluid flow control device of the first zone from a first operating configuration to a second operating configuration.

20 Claims, 6 Drawing Sheets

(56) References Cited

U.S. PATENT DOCUMENTS

| | | | |
|---|---|---|---|
| 2006/0162935 | A1 | 7/2006 | MacDougall |
| 2006/0278399 | A1 | 12/2006 | Dwivedi et al. |
| 2007/0272411 | A1 | 11/2007 | Lopez De Cardenas et al. |
| 2008/0149349 | A1 | 6/2008 | Hiron et al. |
| 2010/0038093 | A1 | 2/2010 | Patel |

* cited by examiner

DOWNHOLE FLUID FLOW CONTROL SYSTEM AND METHOD HAVING DYNAMIC RESPONSE TO LOCAL WELL CONDITIONS

CROSS-REFERENCE TO RELATED APPLICATIONS

This is a continuation application of co-pending application Ser. No. 13/459,654, filed Apr. 30, 2012, which claims the benefit under 35 U.S.C. §119 of the filing date of International Application No. PCT/US2011/049527, filed Aug. 29, 2011. The entire disclosures of the prior applications are incorporated herein by this reference.

TECHNICAL FIELD OF THE INVENTION

This invention relates, in general, to equipment utilized in conjunction with operations performed in subterranean wells and, in particular, to a downhole fluid flow control system and method having dynamic response to local well conditions to control the inflow of formation fluids and the outflow of injection fluids.

BACKGROUND OF THE INVENTION

Without limiting the scope of the present invention, its background will be described with reference to producing fluid from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to control the inflow of production fluids, it is common practice to install one or more flow control devices within the tubing string. The flow control devices may include one or more flow control components such as flow tubes, nozzles, labyrinths or the like. Typically, the production flowrate through these flow control devices is fixed prior to installation by the number and design of the flow control components. It has been found, however, that due to changes in formation pressure and changes in formation fluid composition over the life of the well, it may be desirable to adjust the flow control characteristics of the flow control devices. In addition, for certain completions, such as long horizontal completions having numerous production intervals, it may be desirable to independently control the inflow of production fluids into each of the production intervals. Further, in some completions, it would be desirable to adjust the flow control characteristics of the flow control devices without the requirement for well intervention.

Accordingly, a need has arisen for an improved flow control system that is operable to control the inflow of formation fluids. A need has also arisen for such a flow control system that is operable to independently control the inflow of production fluids from multiple production intervals and operable to control the inflow of production fluids without the requirement for well intervention as formation pressure or fluid composition changes over time.

SUMMARY OF THE INVENTION

The present invention disclosed herein comprises a downhole fluid flow control system and method having dynamic response to local well conditions to control the inflow of formation fluids and the outflow of injection fluids. In addition, the downhole fluid flow control system and method of the present invention are operable to independently control the inflow of production fluids into multiple production intervals without the requirement for well intervention as formation pressure or the composition of the fluids produced into specific intervals changes over time.

In one aspect, the present invention is directed to a downhole fluid flow control system. The downhole fluid flow control system includes a tubing string operably positionable in a wellbore. Annular barriers are positioned between the tubing string and the wellbore to isolate first and second zones. A fluid flow control device is positioned within each zone. A flow tube operably associated with the fluid flow control device of the first zone operable to establish fluid communication between the second zone and the fluid flow control device in the first zone such that a differential pressure between the first zone and the second zone is operable to actuate the fluid flow control device of the first zone from a first operating configuration to a second operating configuration.

In one embodiment, the first operating configuration is an open position and the second operating configuration is a closed position. In another embodiment, the first operating configuration is a closed position and the second operating configuration is an open position. In a further embodiment, the first operating configuration is an open position and the second operating configuration is a restricted position. In certain embodiments, the flow tube extends through at least one of the annular barriers. In some embodiments, a flow tube operably associated with the fluid flow control device of the second zone extends through at least one of the annular barriers to establish fluid communication between the first zone and the fluid flow control device in the second zone such that a differential pressure between the first zone and the second zone is operable to actuate the fluid flow control device of the second zone from a first operating configuration to a second operating configuration.

In another aspect, the present invention is directed to a downhole fluid flow control method. The method includes isolating first and second zones in a wellbore, each zone having a fluid flow control device positioned therein, establishing fluid communication between the first zone and the fluid flow control device in the second zone, flowing fluid through the fluid flow control device of the first zone, generating a differential pressure between the first zone and the second zone and actuating the fluid flow control device of the second zone from a first operating configuration to a second operating configuration responsive to the differential pressure.

The method may also include installing annular barriers between the tubing string and the wellbore, extending a flow tube through at least one of the annular barriers, injecting a fluid from an interior of the tubing string into the formation through the first zone, performing an acid stimulation of the first zone, performing a fracture operation in the formation, changing the viscosity of the fluid or actuating the fluid flow control device of the second zone from a closed position to an open position.

In another aspect, the present invention is directed to a downhole fluid flow control method. The method includes isolating first and second zones in a wellbore, each zone having a fluid flow control device positioned therein, establishing fluid communication between the second zone and the fluid flow control device in the first zone, flowing fluid through the fluid flow control devices of the first zone and the second zone, generating a differential pressure between the first zone and the second zone and actuating the fluid flow control device of the first zone from a first operating configuration to a second operating configuration responsive to the differential pressure.

The method may also include installing annular barriers between the tubing string and the wellbore, extending a flow tube through at least one of the annular barriers, producing fluid from the formation into an interior of the tubing string through the first zone and the second zone, transitioning from production of a desired fluid to production of an undesired fluid in the first zone, increasing the flowrate of the fluid produced through the first zone, changing the viscosity of the fluid produced through the first zone, actuating the fluid flow control device of the first zone from an open position to a restricted position or actuating the fluid flow control device of the first zone from an open position to a closed position.

In another aspect, the present invention is directed to a downhole fluid flow control method. The method includes isolating first and second zones in a wellbore, each zone having a fluid flow control device positioned therein, establishing fluid communication between the second zone and the fluid flow control device in the first zone, establishing fluid communication between the first zone and the fluid flow control device in the second zone, injecting fluid from a tubing string through the fluid flow control device of the first zone into a formation, generating a differential pressure between the first zone and the second zone and responsive to the differential pressure, opening the fluid flow control device in the second zone and closing the fluid flow control device in the first zone.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
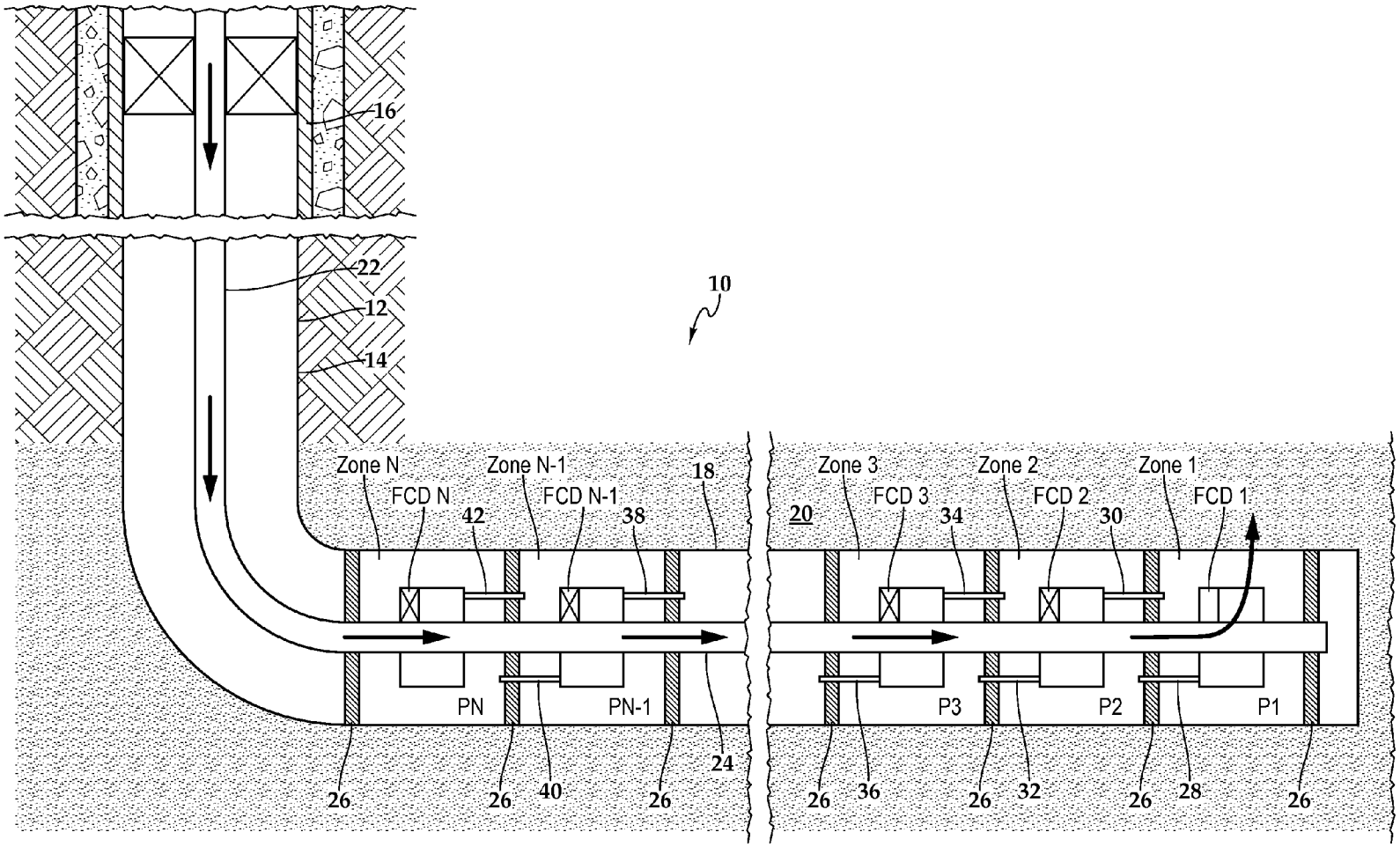
FIG. 1 is a schematic illustration of a well system operating a fluid flow control system according to an embodiment of the present invention during a first phase of a treatment operation.

Referring initially to FIG. 1, therein is depicted a well system including a downhole fluid flow control system embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string 24 that has been installed in wellbore 12 and divides the completion interval into various production intervals identified as zone 1, zone 2, zone 3 . . . zone N−1 and zone N. Completion string 24 includes a plurality of flow control devices identified as FCD 1, FCD 2, FCD 3, FCD N−1 and FCD N, wherein FCD 1 corresponds with zone 1, FCD 2 corresponds to zone 2 and so forth. Each of the flow control devices is depicted as being positioned between a pair of annular barriers 26 that extend between completion string 24 and wellbore 12, thereby isolating the production intervals. As used herein, the term annular barrier may refer to any suitable pressure barrier known to those skilled in the art including, but not limited to, production packers, inflatable packer, swellable packer or the like as well as materials such as gravel packs or other wellbore filler materials that are operable to provide a pressure differential thereacross, thereby isolating zones in the wellbore. The annular barriers may or may not provide a complete seal between the tubing string and the wellbore.

In the illustrated embodiment, the flow control devices may serve numerous functions. For example, the flow control devices may function as filter media such as a wire wrap screen, a woven wire mesh screen, a prepacked screen or the like, with or without an outer shroud positioned therearound, designed to allow fluids to flow therethrough but prevent particulate matter of a predetermined size from flowing therethrough. In addition, the flow control devices may function as inflow control devices to regulate the flow of a production fluid stream during the production phase of well operations or as outflow control devices to control the flow of an injection fluid stream during a treatment phase of well operations or both. The inflow and outflow control may be accomplished using the same or different components within the flow control devices such that the desired flowrates are achieved. For example, it may be desirable to have a higher injection rate than the intended production rate through the flow control devices in which case different injection valves and production valves may be used or more injection valves than production valves may be used. As explained in greater detail below, when operated in the system and according to the methods of the present invention, the flow control devices are also operable to dynamically respond to local well conditions to control the inflow of formation fluids or the outflow of injection fluids through the various zones of the wellbore. It is noted that the function of inflow or outflow control during production or injection operations and the function of dynamic response to wellbore conditions may be performed by the same or different components within the flow control devices.

For example, inflow or outflow control during production or injection operations may be achieved using fluid flow resistors such as nozzles, flow tubes, labyrinths or other tortuous path flow resistors, as well as vortex chambers or other fluidic diodes, matrix chambers containing fluid flow resisting filler material such as bead or fluid selector materials that swell when in contact with hydrocarbons, water or other stimulants such as pH, ionic concentration or the like. The function of dynamic response to wellbore conditions may be achieved using valves such as sliding sleeves, piston operated valves, velocity valves or the like. Alternatively, both inflow or outflow control during production or injection operations and dynamic response to wellbore conditions could be performed by the same component such as a choke or other infinitely variable valving assembly.

Still referring to FIG. 1, each of the flow control devices is in communication with one or more adjacent zones, for example, fluid communication, fluid pressure communication or the like. Specifically, FCD 1 is operably associated with a flow tube 28 proving upstream communication with zone 2 through one of the annular barriers 26. As used herein, the term flow tube shall mean any medium capable of providing a communication path, such as a fluid or pressure communication path, between a flow control device and another zone. For example, the flow tubes may be control lines or other tubing in the annulus between the tubing string and the wellbore that extend through one or more annular barriers. Alternatively, the flow tubes could be concentric tubulars around the tubing string that extend through and are preferably positioned interiorly of one or more annular barriers. The flow tubes may provide an unencumbered communication path between a flow control device and another zone or the flow tubes may include valving, pistons or other flow control or pressure operated devices. In the illustrated embodiment, FCD 2 is operably associated with a flow tube 30 proving downstream communication with zone 1 through one of the annular barriers 26. Also, FCD 2 is operably associated with a flow tube 32 proving upstream communication with zone 3 through one of the annular barriers 26. FCD 3 is operably associated with a flow tube 34 proving downstream communication with zone 2 through one of the annular barriers 26. Also, FCD 3 is operably associated with a flow tube 36 proving upstream communication through one of the annular barriers 26. FCD N−1 is operably associated with a flow tube 38 proving downstream communication through one of the annular barriers 26. Also, FCD N−1 is operably associated with a flow tube 40 proving upstream communication with zone N through one of the annular barriers 26. FCD N is operably associated with a flow tube 42 proving downstream communication with zone N−1 through one of the annular barriers 26. Even though FIG. 1 depicts each flow control device in communication with one or more adjacent zones via the flow tubes, it is to be understood by those skilled in the art that the flow control devices in the present invention could alternatively or additionally be in communication with one or more remote zones that are not adjacent to the zone in which that flow control device operates.

Even though FIG. 1 depicts the flow control system of the present invention in an open hole environment, it should be understood by those skilled in the art that the present invention is equally well suited for use in cased wells. Also, even though FIG. 1 depicts one flow control device in each production interval, it should be understood by those skilled in the art that any number of flow control devices may be deployed within a production interval without departing from the principles of the present invention. In addition, even though FIG. 1 depicts the flow control system of the present invention in a horizontal section of the wellbore, it should be understood by those skilled in the art that the present invention is equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The operation of the downhole fluid flow control system having dynamic response to local well conditions will now be described with reference to FIGS. 1-4. In FIG. 1, a tubing string depicted as completion string 24 has been located in wellbore 12. A plurality of annular barriers 26 has been deployed which isolate a plurality of zones; namely, zone 1-zone N. Each zone includes a fluid flow control device FCD 1-FCD N that is in fluid communication with one or more other zones via flow tubes 28-42. FIG. 1 depicts a first stage of a treatment operation wherein FCD 1 is in the open position and FCD 2-FCD N are all in the closed position such that the treatment fluid, indicated by the arrows, is directed out of completions string 24 into formation 20 through FCD 1 and zone 1. The treatment operation depicted may be an acid treatment, a hydraulic fracturing operation or other operation that requires pumping fluid down the tubing string into a production zone or the formation.

As the treatment fluid is pumped into formation 20 through zone 1, the pressure P1 in zone 1 will change as local well conditions change. For example, during an acid treatment, the pressure P1 in zone 1 will initially be at a high pressure that is above reservoir pressure as the filter cake or other wellbore damage will create resistance to the flow of the treatment fluid into the formation at the surface of the wellbore. As the acid treatment removes the filter cake in zone 1, the pressure P1 will decrease as the resistance to flow into the formation decreases. As another example, during certain fracture operations, the pressure P1 in zone 1 will initially be at a high pressure that is above reservoir pressure as a large volume of treatment fluid is pumped into the formation to create and prop open the hydraulic fractures. When the fractures cease to propagate or a sand out occurs, the pressure P1 will increase. Similarly, in other fracture operations, the pressure P1 in zone 1 will initially be at a high pressure that is above reservoir pressure as a large volume of treatment fluid is pumped into the formation to create and prop open the hydraulic fractures. As the composition of the treatment fluid changes from a high viscosity gel to a lower viscosity fluid, for example, the pressure P1 will decrease as the resistance to flow into the formation decreases. In each of these treatment scenarios, the pressure P1 changes over time and has an expected pressure signature.

Figure 2:
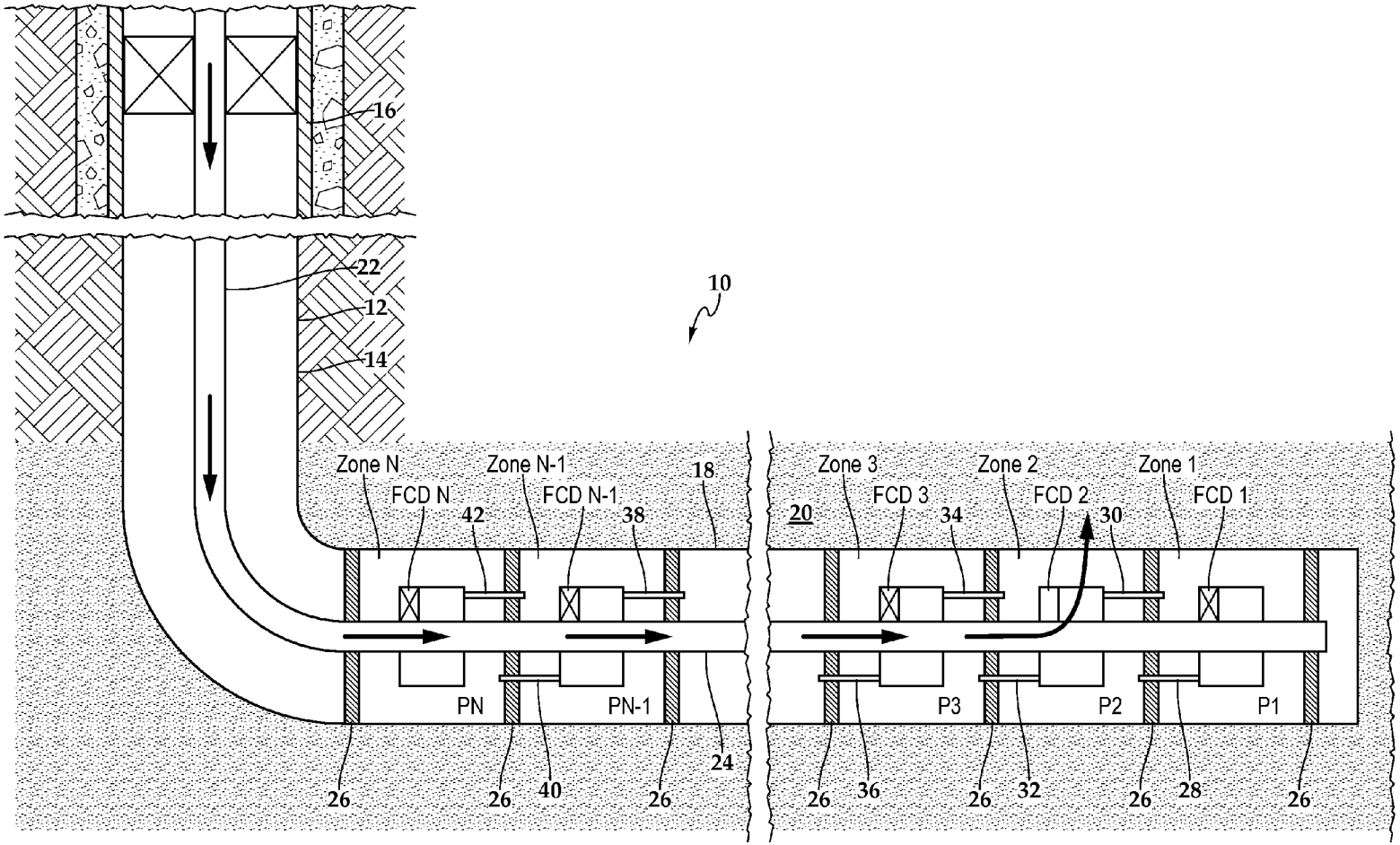
FIG. 2 is a schematic illustration of a well system operating a fluid flow control system according to an embodiment of the present invention during a second phase of a treatment operation.

In the illustrated embodiment, these pressure changes in zone 1 are seen by FCD 2 in zone 2 due to fluid communication through annular barrier 26 via flow tube 30. Depending on the expected pressure signature during the treatment operation, the fluid pressure P1 can be routed to the appropriate side of a piston, sliding sleeve or other operation mechanism within FCD 2. The other side of the piston, sliding sleeve or other operation mechanism within FCD 2 may see the pressure P2 from zone 2, which is initially reservoir pressure. The differential pressure between P1 and P2 thus provides an energy source to operate FCD 2 from a first operating configuration to a second operating configuration. Depending upon the operation being performed and the routing of pressures P1 and P2 into FCD 2, when P1 experiences the desired pressure increase or decrease, a differential pressure is created between P1 and P2 such that, in the illustrated embodiment, FCD 2 is shifted from the closed to the open position, as best seen in FIG. 2.

Depending upon the desired outcome of the treatment operation, once FCD 2 is open, FCD 1 can remain open or preferably, FCD 1 can be closed. In the illustrated embodiment, the pressure P2 in zone 2 is seen by FCD 1 in zone 1 due to fluid communication through annular barrier 26 via flow tube 28. Depending on the expected pressure signature during the treatment operation, the fluid pressure P2 can be routed to an appropriate side of the operation mechanism within FCD 1, the other side of which preferably sees the pressure P1 from zone 1. The differential pressure between P1 and P2 thus provides an energy source to operate FCD 1 from a first operating configuration to a second operating configuration which in this case is shifting FCD 1 from the open to the closed position, as best seen in FIG. 2. Preferably, FCD 2 is opened prior to closing FCD 1. This can be accomplished using a time delay circuit such as a metering fluid to regulate the closing speed of FCD 1. Once FCD 1 is closed, it may be mechanically biased or locked in the closed position using springs, collets or other locking assemblies or it may be biased in the closed position by pressure in the system, such as tubing pressure.

Figure 3:
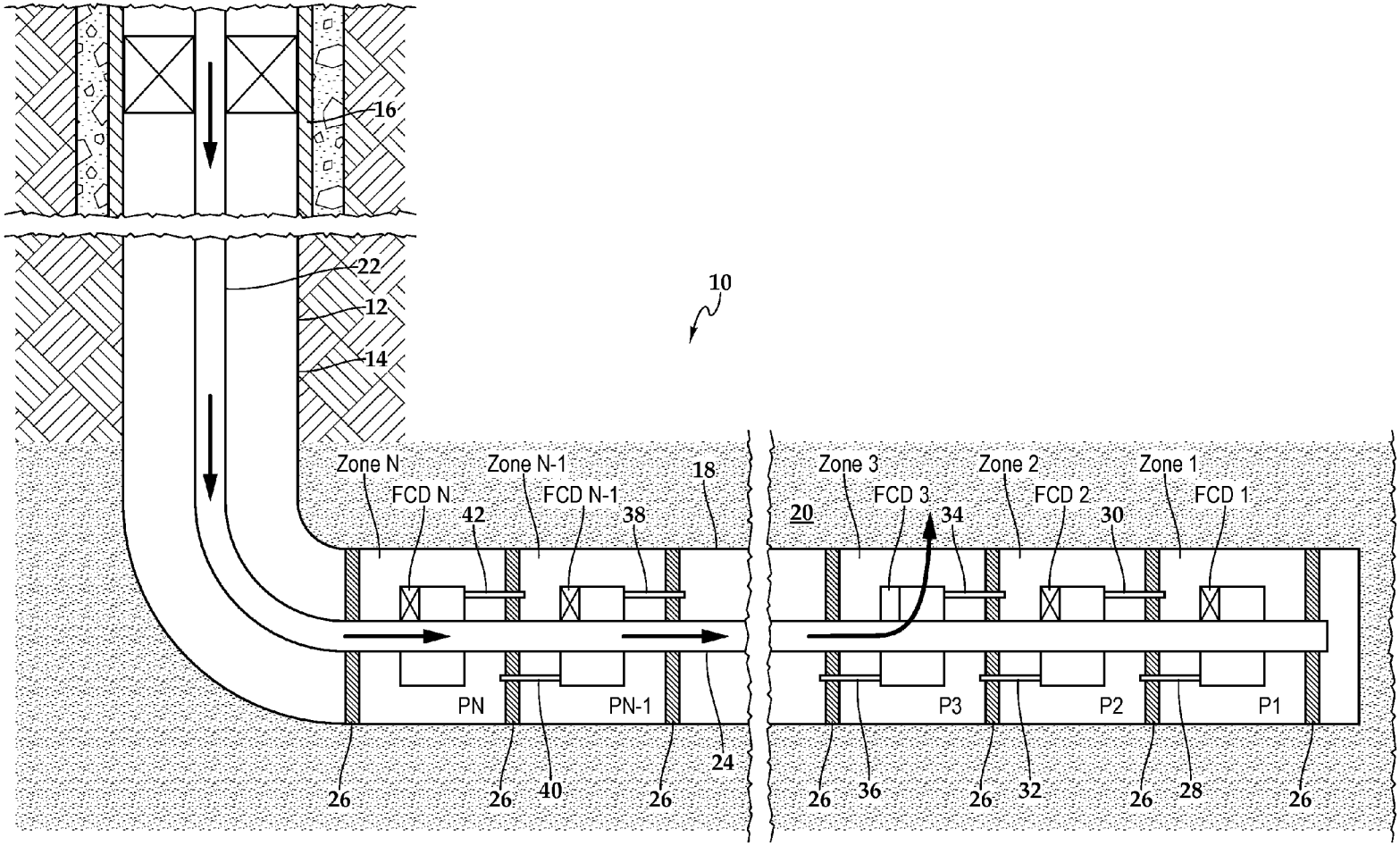
FIG. 3 is a schematic illustration of a well system operating a fluid flow control system according to an embodiment of the present invention during a third phase of a treatment operation.

The treatment operation then continues in zone 2 with the pressure P2 changing over time with an expected pressure signature that depends on the treatment operation being performed. These pressure changes in zone 2 are seen by FCD 3 in zone 3 due to fluid communication through annular barrier 26 via flow tube 34. Depending on the expected pressure signature during the treatment operation, the fluid pressure P2 can be routed to the appropriate side of the operation mechanism within FCD 3 with the other side preferably seeing the pressure P3 from zone 3, which is initially reservoir pressure. The differential pressure between P2 and P3 thus provides an energy source to operate FCD 3 from its closed position to its open position, as best seen in FIG. 3.

Depending upon the desired outcome of the treatment operation, once FCD 3 is open, FCD 2 can remain open or preferably, FCD 2 can be closed. In the illustrated embodiment, the pressure P3 in zone 3 is seen by FCD 2 in zone 2 due to fluid communication through annular barrier 26 via flow tube 32. Depending on the expected pressure signature during the treatment operation, the fluid pressure P3 can be routed to an appropriate side of the operation mechanism within FCD 2, the other side of which preferably sees the pressure P2 from zone 2. The differential pressure between P2 and P3 thus provides an energy source to operate FCD 2 from its open to its closed position, as best seen in FIG. 3. Preferably, FCD 3 is opened prior to closing FCD 2 and FCD 2 is secured in the closed position.

Figure 4:
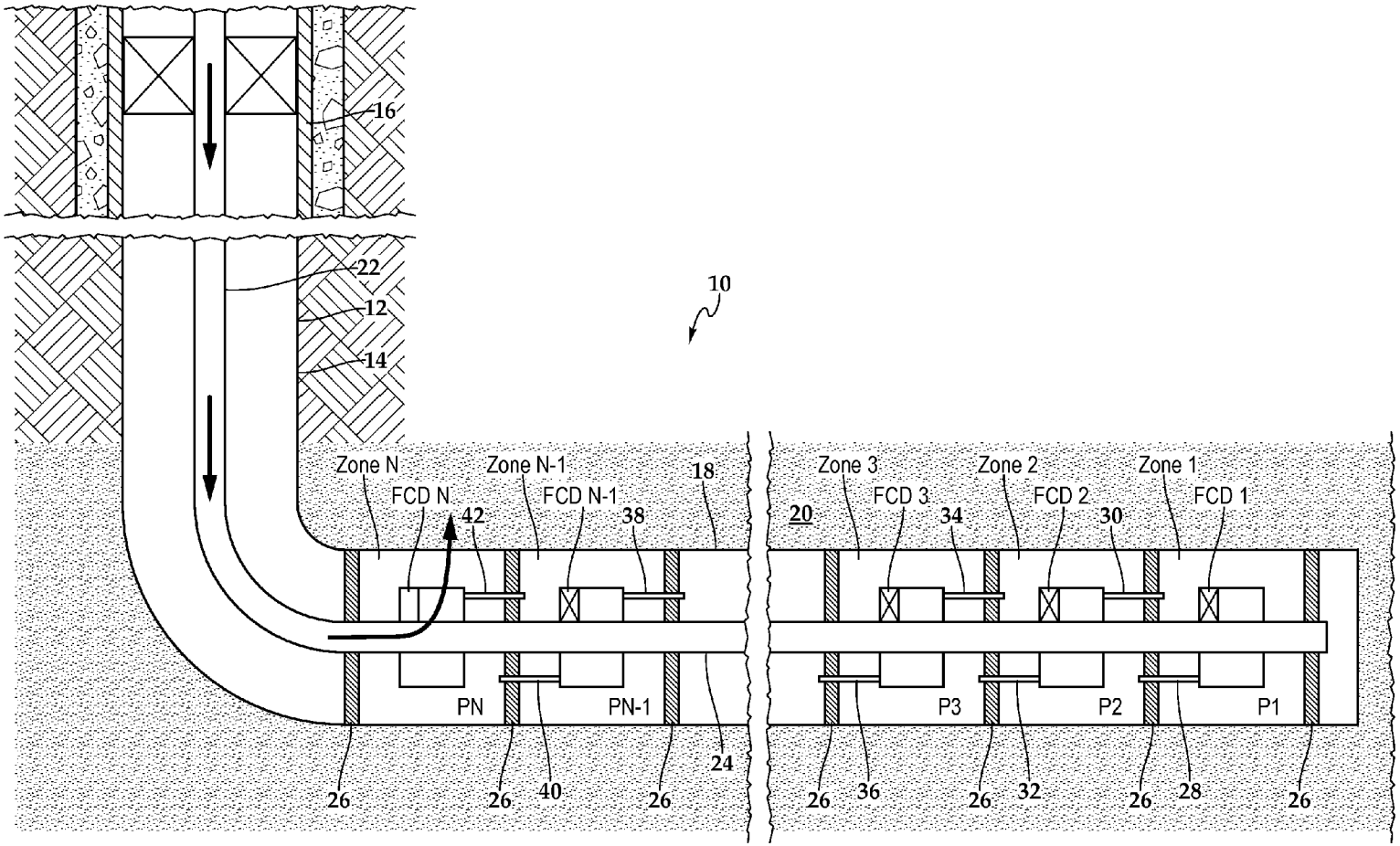
FIG. 4 is a schematic illustration of a well system operating a fluid flow control system according to an embodiment of the present invention during a final phase of a treatment operation.

This process may proceed uphole in a stepwise fashion to accomplish the desired treatment goals until the last zone of wellbore 12 is treated, as best seen in FIG. 4, wherein FCD N is open to allow treatment fluid to enter zone N as indicated by the arrows and all other flow control devices are closed. After the treatment operation has been completed, each of the previously closed flow control devices may be operated to the open position based upon sequential differential pressure changes in the zones. For example, as fluid is produced into zone N, the pressure PN falls below reservoir pressure. This pressure change in zone N is seen by FCD N−1 in zone N−1 due to fluid communication through annular barrier 26 via flow tube 40. The fluid pressure PN can be routed to the appropriate side of the operation mechanism within FCD N−1, the other side of which preferably sees the pressure PN−1 from zone N−1, which is initially reservoir pressure. The differential pressure between PN and PN−1 can be use as an energy source to operate FCD N−1 from its closed position to its open position. This process may proceed downhole in a stepwise fashion until all zones are open to production.

Figure 5:
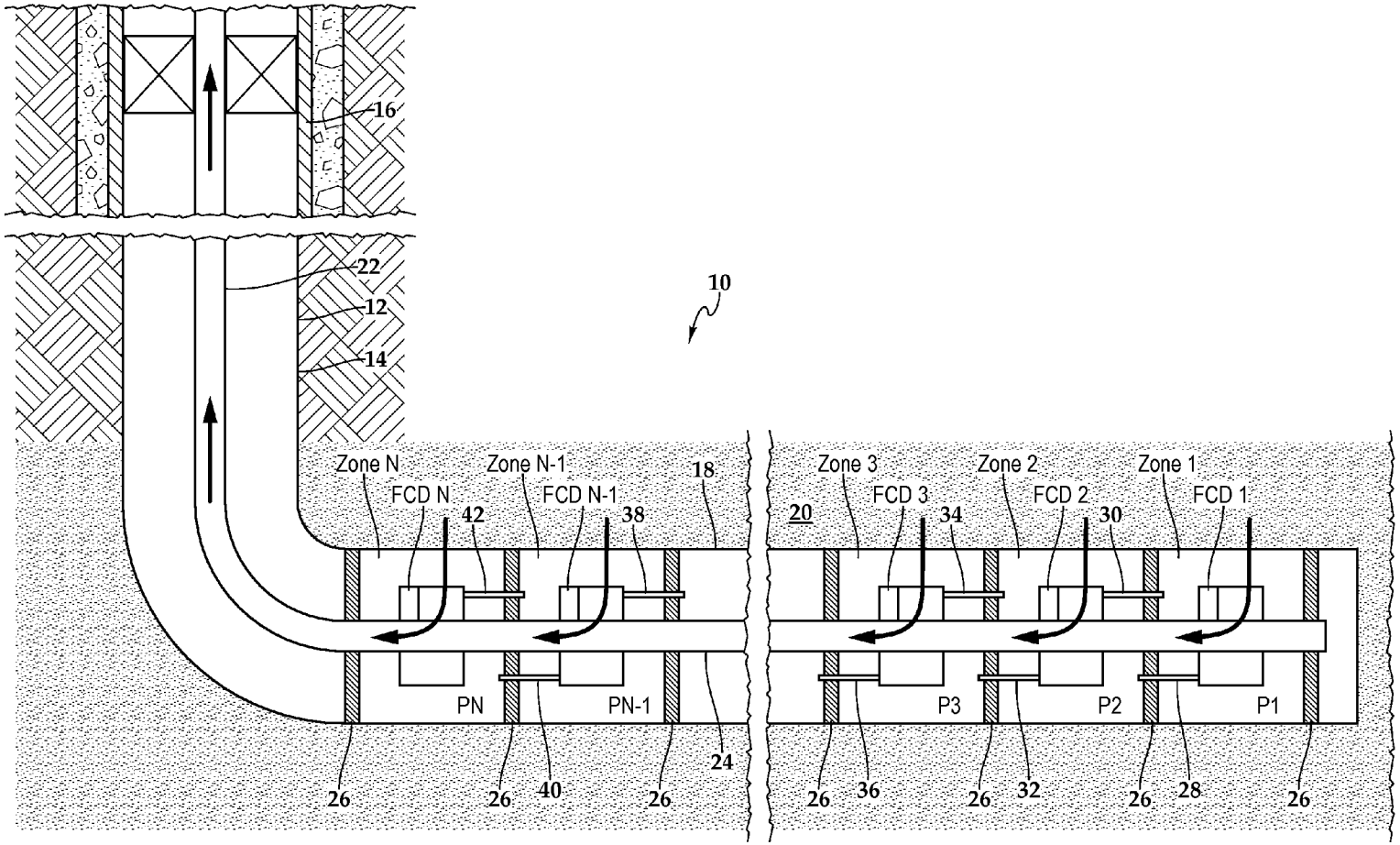
FIG. 5 is a schematic illustration of a well system operating a fluid flow control system according to an embodiment of the present invention during a production operation.
Figure 6:
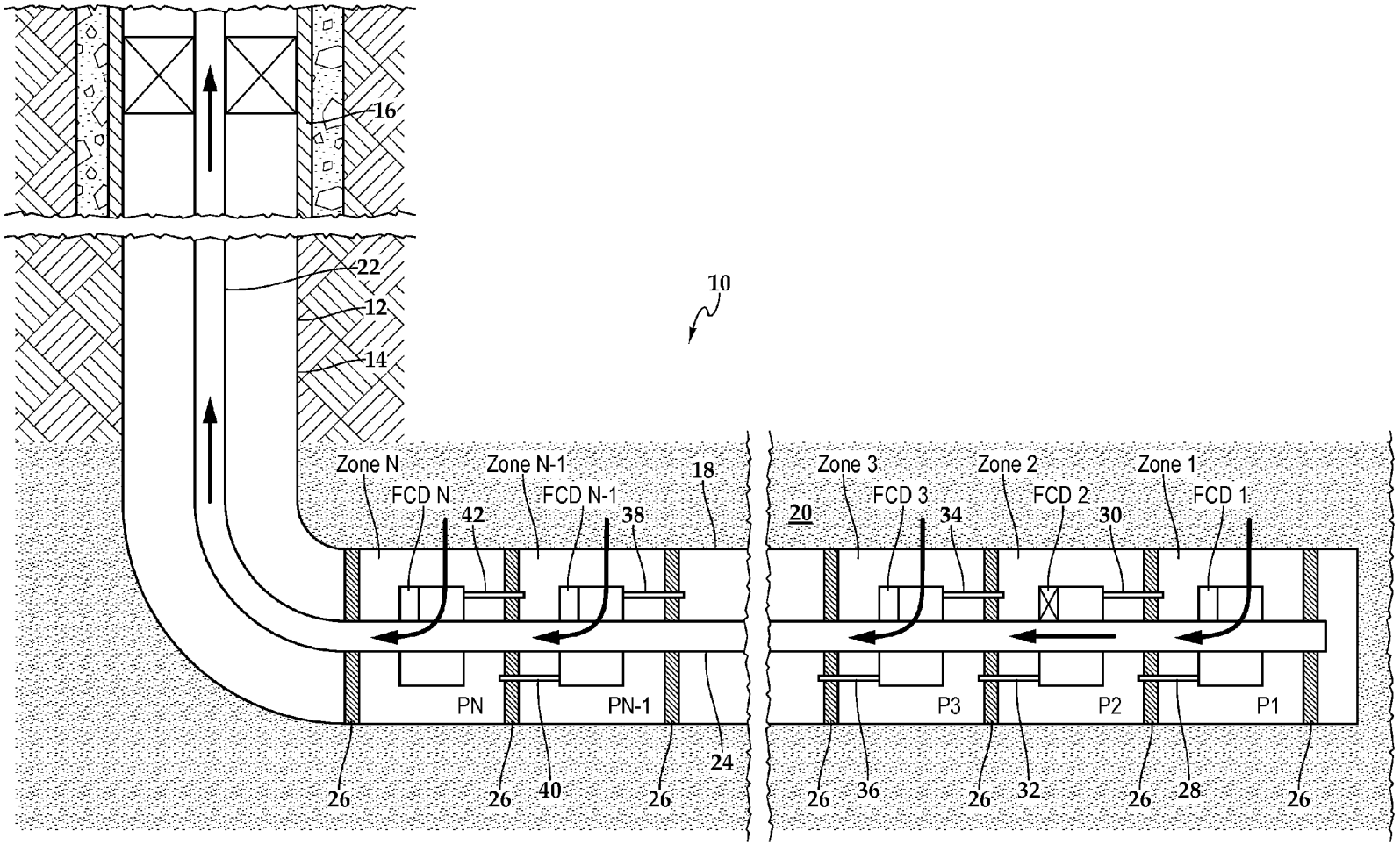
FIG. 6 is a schematic illustration of a well system operating a fluid flow control system according to an embodiment of the present invention during a later phase of the production operation.

Another operation of the downhole fluid flow control system having dynamic response to local well conditions will now be described with reference to FIGS. 5-6. In FIG. 5, a tubing string depicted as completion string 24 has been located in wellbore 12. A plurality of annular barriers 26 has been deployed which isolate a plurality of zones; namely, zone 1-zone N. Each zone includes a fluid flow control device FCD 1-FCD N that is in fluid communication with one or more other zones via flow tubes 28-42. FIG. 5 depicts a production operation wherein each of the flow control devices is in the open position such that the production fluid, indicated by the arrows, flows into completion string 24 through each of the flow control devices and each of the zones.

During the production operation, the inflow control components within FCD 1-FCD N will attempt to regulate and balance production rates through each zone. Under certain conditions, however, the inflow control components may be unable to regulate and balance production rates or it may be desirable to shut-in or highly restrict production from one or more zones due to changes in flowrate through a zone or changes in the composition of a fluid being produced into a zone. For example, if the desired fluid to be produced in the well system is oil and one or more zones begin to produce an undesired fluid such as gas or water, the fluid flow control system of the present invention can dynamically respond to this local well condition. As the viscosity of the oil is generally higher than the viscosity of the gas or water, there is a greater pressure drop experienced by the oil as it migrates through the formation to the wellbore than that experienced by water or gas. As such, when water or gas is produced into a zone, the pressure in that zone is greater than the pressure in a zone producing oil. Likewise, if the flowrate into a zone increases due to, for example, a fissure in the formation, this low resistance region in the formation could lead to early water or gas production. As such, when oil is produced into a zone from a high permeability region in the formation, the pressure in that zone is greater than the pressure in a zone producing oil through a normal permeability region of the formation. In each of these production scenarios, the pressure difference in various zones can be used to control production.

In the illustrated embodiment, if a change in flowrate or fluid composition has resulted in a higher pressure in zone 2 than in zone 1 or zone 3 or both, these pressure differences are seen by FCD 2 in zone 2 due to fluid communication through annular barrier 26 via flow tubes 30, 32. The fluid pressure P1 or P3 can be routed to the appropriate side of a piston, sliding sleeve or other operation mechanism within FCD 2 with the other side of the piston, sliding sleeve or other operation mechanism within FCD 2 seeing the pressure P2 from zone 2. The differential pressure between P1 and P2 or P3 and P2 thus provides an energy source to operate FCD 2 from a first operating configuration to a second operating configuration. For example, when the differential pressure reaches a predetermined level, FCD 2 could be operated from its open position to a choked position or FCD 2 could be operation from its open position to a closed position, as best seen in FIG. 6. Preferably, FCD 2 is then secured in the closed position. The process will continue interventionlessly throughout the wellbore system as production fluid flowrates or compositions change in the various zones, with differential pressures providing the energy for the closure of the desired flow control devices. It should be noted that the required differential pressure needed to operate the various flow control devices may be different in different zones and may be preselected or predetermined.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole fluid flow control method for sequentially treating multiple zones, the method comprising:

isolating first and second zones in a wellbore, each zone having a fluid flow control device positioned therein;

establishing communication between the second zone and the fluid flow control device in the first zone;

establishing communication between the first zone and the fluid flow control device in the second zone;

injecting a treatment fluid from a tubing string through the fluid flow control device of the first zone while the fluid flow control devices of the second zone is in the closed position;

generating a differential pressure between the first zone and the second zone;

responsive to the differential pressure, dynamically opening the fluid flow control device in the second zone and dynamically closing the fluid flow control device in the first zone; and injecting the treatment fluid from the tubing string through the fluid flow control device of the second zone while the fluid flow control devices of the first zone is in the closed position.

2. The downhole fluid flow control method as recited in claim 1 wherein isolating first and second zones in the wellbore further comprises installing annular barriers between a tubing string and the wellbore.

3. The downhole fluid flow control method as recited in claim 1 wherein injecting fluid from the tubing string through the fluid flow control device of the first zone further comprises performing an acid stimulation of the first zone.

4. The downhole fluid flow control method as recited in claim 1 wherein injecting fluid from the tubing string through the fluid flow control device of the first zone further comprises performing a fracture operation in the formation.

5. The method as recited in claim 1 wherein, after closing the fluid flow control device in the first zone, locking the fluid flow control device in the first zone.

6. The method as recited in claim 1 wherein generating the differential pressure between the first zone and the second zone further comprises changing the viscosity of the treatment fluid.

7. The method as recited in claim 1 wherein generating the differential pressure between the first zone and the second zone further comprises removing filter cake from the first zone.

8. The method as recited in claim 1 wherein generating the differential pressure between the first zone and the second zone further comprises sanding out in the first zone.

9. The method as recited in claim 1 wherein generating the differential pressure between the first zone and the second zone further comprises ceasing to propagate fractures in the first zone.

10. A downhole fluid flow control system for sequentially treating multiple zones, the system comprising:

a tubing string operably positionable in a wellbore;

at least one annular barrier positionable between the tubing string and the wellbore to isolate first and second zones;

a fluid flow control device positioned within each zone;

a first flow tube operably associated with the fluid flow control device of the first zone, the first flow tube establishing communication between the second zone and the fluid flow control device in the first zone; and a second flow tube operably associated with the fluid flow control device of the second zone, the second flow tube establishing communication between the first zone and the fluid flow control device in the second zone;

wherein, when injecting a treatment fluid from the tubing string through the fluid flow control device of the first zone while the fluid flow control devices of the second zone is in the closed position generates a predetermined differential pressure between the first zone and the second zone, the fluid flow control device in the second zone is dynamically opened and the fluid flow control device in the first zone is dynamically closed.

11. The downhole fluid flow control system as recited in claim 10 wherein the first and second flow tubes extend through the at least one annular barrier.

12. A downhole fluid flow control method for controlling production in multiple zones, the method comprising:

isolating first, second and third zones in a wellbore, each zone having a fluid flow control device positioned therein;

establishing communication between the second zone and the fluid flow control device in the first zone;

establishing communication between the first zone and the fluid flow control device in the second zone;

establishing communication between the third zone and the fluid flow control device in the second zone;

establishing communication between the second zone and the fluid flow control device in the third zone;

producing fluid into a tubing string through the fluid flow control devices of the first, second and third zones while the fluid flow control devices of the first, second and third zones are open; generating a first differential pressure between the first zone and the second zone;

generating a second differential pressure between the second zone and the third zone;

responsive to at least one of the first and second differential pressures, interventionlessly operating the fluid flow control device in the second zone from the open position to a closed position; and continuing to produce fluid into the tubing string through the fluid flow control devices of the first and third zones.

13. The downhole fluid flow control method as recited in claim 12 wherein isolating first, second and third zones in the wellbore further comprises installing annular barriers between a tubing string and the wellbore.

14. The method as recited in claim 12 wherein, after closing the fluid flow control device in the second zone, locking the fluid flow control device in the second zone.

15. The method as recited in claim 12 wherein generating the first differential pressure between the first zone and the second zone and generating the second differential pressure between the second zone and the third zone are responsive to a change in fluid viscosity of the fluid produced in the second zone.

16. The method as recited in claim 12 wherein generating the first differential pressure between the first zone and the second zone and generating the second differential pressure between the second zone and the third zone are responsive to a change in fluid flowrate of the fluid produced in the second zone.

17. The method as recited in claim 12 wherein generating the first differential pressure between the first zone and the second zone and generating the second differential pressure between the second zone and the third zone are responsive to a change in fluid composition of the fluid produced in the second zone.

18. The method as recited in claim 12 wherein generating the first differential pressure between the first zone and the second zone and generating the second differential pressure between the second zone and the third zone are responsive to production of an undesired fluid in the second zone.

19. A downhole fluid flow control system for controlling production in multiple zones, the system comprising:

a tubing string operably positionable in a wellbore;

a plurality of annular barriers positionable between the tubing string and the wellbore to isolate first, second and third zones;

a fluid flow control device positioned within each zone;

a first flow tube establishing communication between the second zone and the fluid flow control device in the first zone;

a second flow tube establishing communication between the third zone and the fluid flow control device in the second zone;

a third flow tube establishing communication between the first zone and the fluid flow control device in the second zone; and a fourth flow tube establishing communication between the second zone and the fluid flow control device in the third zone;

wherein, producing fluid into the tubing string through the fluid flow control devices of the first, second and third zones while the fluid flow control devices of the first, second and third zones are open generates a first differential pressure between the first zone and the second zone and a second differential pressure between the second zone and the third zone; and wherein, responsive to at least one of the first and second differential pressures, the fluid flow control device in the second zone interventionlessly operating from the open position to a closed position while continuing to produce fluid into the tubing string through the fluid flow control devices of the first and third zones.

20. The downhole fluid flow control system as recited in claim 19 wherein each of the flow tubes extends through at least one of the annular barriers.

* * * * *